US008191286B2

(12) United States Patent
Krikorian

(10) Patent No.: US 8,191,286 B2
(45) Date of Patent: Jun. 5, 2012

(54) TRACTION CLEAT SYSTEM FOR AN ATHLETIC SHOE

(75) Inventor: Rand J. Krikorian, Brentwood, TN (US)

(73) Assignee: Softspikes, LLC, Brentwood, TN (US)

( * ) Notice: Subject to any disclaimer, the term of this patent is extended or adjusted under 35 U.S.C. 154(b) by 552 days.

(21) Appl. No.: 12/413,042

(22) Filed: Mar. 27, 2009

(65) Prior Publication Data

US 2009/0241379 A1 Oct. 1, 2009

Related U.S. Application Data

(60) Provisional application No. 61/039,801, filed on Mar. 27, 2008.

(51) Int. Cl.
*A43B 5/00* (2006.01)
*A43C 13/04* (2006.01)

(52) U.S. Cl. ..... 36/134; 36/67 D; 36/59 R; 36/15

(58) Field of Classification Search ..... 36/134, 36/67 D, 59 R, 15, 59 C
See application file for complete search history.

(56) References Cited

U.S. PATENT DOCUMENTS

| | | | | |
|---|---|---|---|---|
| 736,082 | A | 8/1903 | Foreman | |
| 2,203,929 | A | 6/1940 | Shapiro | |
| 3,526,976 | A * | 9/1970 | Jacobs | 36/100 |
| 3,818,617 | A * | 6/1974 | Dassler et al. | 36/32 R |
| 4,562,651 | A | 1/1986 | Frederick et al. | |
| 4,742,626 | A | 5/1988 | Tadiotto | |
| 4,782,604 | A * | 11/1988 | Wen-Shown | 36/127 |
| 5,197,210 | A | 3/1993 | Sink | |
| 5,661,915 | A | 9/1997 | Smith | |
| 6,305,104 | B1 | 10/2001 | McMullin | |
| 6,449,878 | B1 | 9/2002 | Lyden | |
| 2006/0032092 | A1 | 2/2006 | Drollinger | |
| 2007/0163148 | A1 | 7/2007 | Laporte | |

* cited by examiner

*Primary Examiner* — Ted Kavanaugh
(74) *Attorney, Agent, or Firm* — Edell, Shapiro & Finnan, LLC

(57) ABSTRACT

A traction cleat system for an athletic shoe is disclosed. The system includes an elongated receptacle that receives a cleat strip. The elongated receptacle may be a channel or notch formed into the sole of the shoe. In one embodiment, the cleat strip includes an elongated, flexible hub, a cleat connector, and traction elements depending from the hub. The cleat strip is removable from the receptacle, permitting easy replacement of the cleat assembly when the traction elements become worn.

24 Claims, 6 Drawing Sheets

TRACTION CLEAT SYSTEM FOR AN ATHLETIC SHOE

CROSS REFERENCE TO RELATED APPLICATIONS

The present application is a nonprovisional application of U.S. Provisional Application No. 61/039,801, entitled Athletic Shoe Cleat System and filed 27 Mar. 2008, the disclosure of which is hereby incorporated by reference in its entirety.

FIELD OF THE INVENTION

The present invention is directed toward a traction cleat system for use with an athletic shoe and, in particular, a removable cleat system for a golf shoe.

BACKGROUND OF THE INVENTION

There are a variety of forces exerted on an athletic shoe requiring the use of cleats for traction. For example, a golf shoe is exposed to both rotational and lateral forces during game play. Specifically, the shoe is exposed to rotational or torsional twisting during a golf swing, as well as to lateral (side-to-side) forces as the weight of a golfer is shifted from the front foot to the back foot during the backswing and, similarly, from the back foot to the front foot during the downswing and follow through. Other forces are present when the golfer is walking (and not swinging a club). For example, when the golfer walks along an uneven surface or slick terrain, traction is needed from the cleats to minimize the propensity to slip (which is generated by a lateral force).

A conventional cleat system includes a plurality of mounting receptacles spaced at predetermined positions about a shoe sole. Conventional mounting receptacles include a circular base and a socket coaxially or centrally disposed on the base. The socket is internally threaded and securely mates with an externally threaded stem on a cleat. The cleat typically includes a generally rigid hub and one or more traction elements depending from the hub. The aforementioned stem extends from the upper surface of the hub, while the traction elements extend from its lower surface.

The location of each mounting receptacle within the sole follows the general pattern established years ago by metal cleat systems installed into leather soles. This configuration, however, limits the number of cleats—and thus the number of traction elements—that may be disposed on the shoe. In addition, the circular base configuration limits the ability to move the traction elements close to the edge of the sole and further away from the center of rotation of the shoe. Conventional (circular) bases possess a set diameter; moreover, shoe manufacturers require 2 mm to 10 mm of clearance between the edge of the base and the edge of the shoe sole. As a result, the socket that captures the cleat is oriented a significant distance from the edge of the sole and, as such, closer to the center of rotation of the shoe.

Thus, it would be desirable to provide a cleat system that provides maximum stability to a wearer during a myriad of activities and, in particular, to provide a golfing shoe that provides a more stable platform for the golfer.

SUMMARY OF THE INVENTION

A traction cleat system for an athletic shoe is disclosed. The system includes an elongated receptacle that receives a cleat strip. The elongated receptacle may be a channel or notch formed into the sole of the shoe. In one embodiment, the cleat strip includes an elongated, flexible hub, a cleat connector, and traction elements depending from the hub. The cleat strip is removable from the receptacle, permitting easy replacement of the cleat assembly when the traction elements become worn.

BRIEF DESCRIPTION OF THE DRAWINGS

Like reference numerals have been used to identify like elements throughout this disclosure.

DETAILED DESCRIPTION OF THE INVENTION

Figure 1:
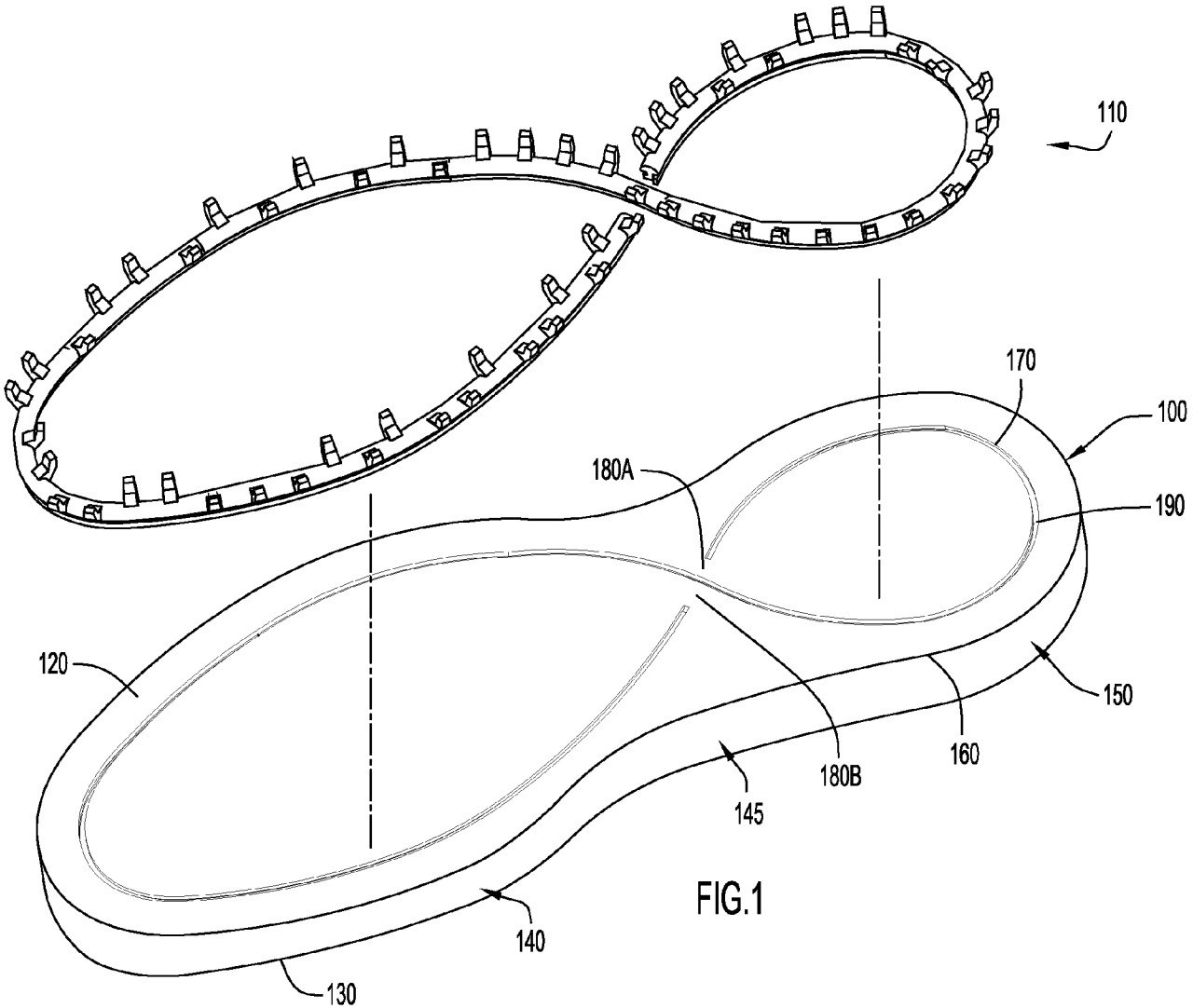
FIG. 1 illustrates an exploded view of a cleat system in accordance with an embodiment of the present invention.

FIG. 1 illustrates an exploded view of a traction cleat system in accordance with an embodiment of the invention. As shown, the system includes a shoe sole 100 and a cleat assembly 110. The sole 100 may be a generally planar member having a lower (ground-facing) surface 120 and an upper (shoe-facing) surface 130 that cooperate to define sole peripheral edge 160 (also called an outboard edge). The sole 100 includes a forward portion 140 (oriented proximate the ball of the foot), an intermediate or arch portion 145, and a rear or heel portion 150. The sole 100 further includes a longitudinal dimension (the length of the sole) and a latitudinal or transverse dimension (the width of the sole).

The sole 100 further includes a receptacle 170 adapted to mate with the connector of the cleat assembly 110 (discussed in greater detail below). The receptacle 170 may be a separate component secured within the sole 100 (e.g., a mounting connector molded into the sole 100). Alternatively, the receptacle 170 may be formed such that it is integral with the sole 100 (i.e., the receptacle 170 is a cavity with interior walls defined by the sole 100). By way of example, the sole 100 may be formed by utilizing a molding process such as the one described in U.S. Pat. No. 6,248,278 (Kelly), the entire disclosure of which is incorporated herein by reference in its entirety.

In a preferred embodiment, the receptacle 170 is an elongated or non-circular groove or notch formed into the outsole in a predetermined receptacle pattern. The receptacle 170 may be positioned within the sole in any pattern suitable for its intended purpose. The pattern, moreover, may be customized to provide the desired degree of traction. For example, the receptacle 170 may be positioned adjacent the entire sole peripheral edge 160, extending from the forward portion 140 of the sole to the rear portion 150 of the sole. Alternatively, the receptacle may be positioned within any portion(s) of the shoe sole (e.g., the forward sole portion 140 and/or rear sole portion 150). The receptacle 170 may continuously extend along the sole 100 or may be interrupted by one or more breaks.

In the embodiment illustrated to in FIG. 1, the receptacle 170 possesses a figure-eight-shaped pattern interrupted by a pair of breaks 180A, 180B. As shown, the receptacle 170 includes one or more arcuate portions 190, i.e., an area of the receptacle that curves or bends across the sole 100. That is, as the receptacle 170 spans the length of the sole, the receptacle 170 curves laterally (outward and/or inward with respect to the sole peripheral edge 160). These arcuate portions accommodate the curves of the sole peripheral edge 160, as well as control the positioning of the cleat assembly (and thus the cleat matrix) with respect to the sole 100.

The receptacle 170 is located proximate (slightly inboard of) the sole peripheral edge 160 at a predetermined setback distance. By way of example, an outboard-facing lateral edge of the receptacle 170 may be disposed in the range of about 2 mm to 10 mm from the sole peripheral edge 160. By way of specific example, the outboard-facing edge of the receptacle 170 may be located about 3 mm to 5 mm from the sole peripheral edge 160. Positioning the receptacle 170 closer to the sole peripheral edge 160 is advantageous because it widens the performance track of the cleats. Widening the performance track provides more stable traction since the traction elements are positioned furthest away from the center of rotation of the shoe (discussed in greater detail below).

Figure 2:
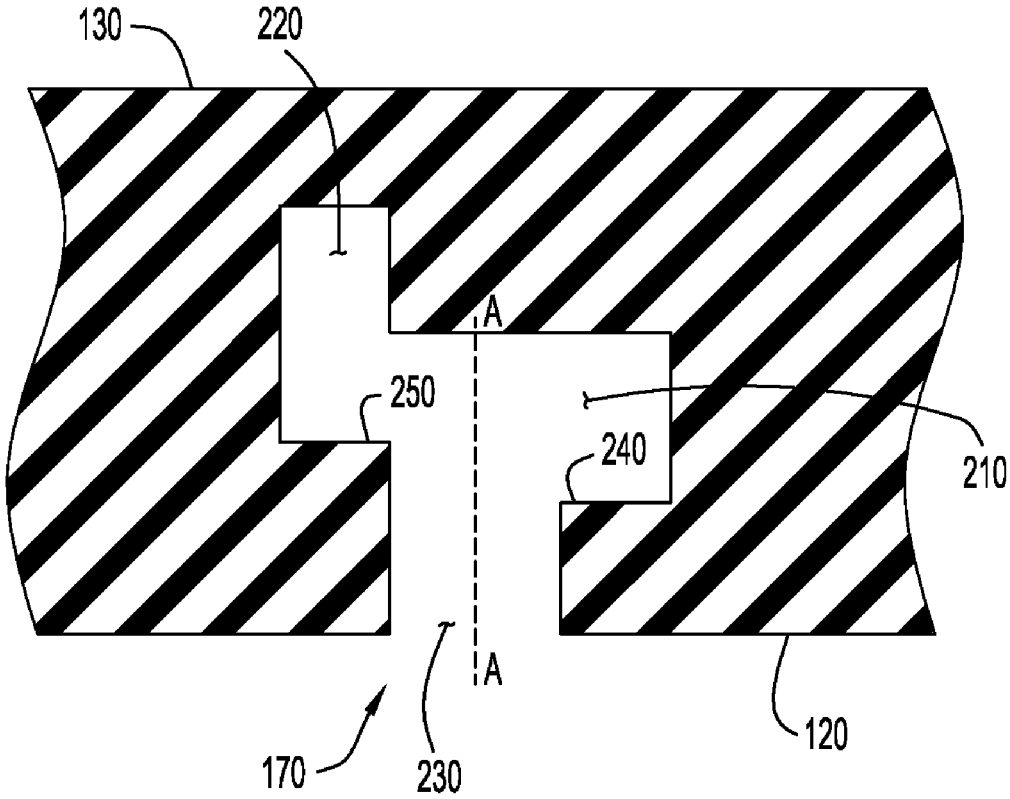
FIG. 2 illustrates a partial, transverse cross-sectional view of a shoe sole, showing the cleat receptacle in accordance with an embodiment of the invention.

The receptacle 170 may possess any shape and dimensions suitable for its intended purpose. Referring to FIG. 2, the receptacle 170 is an elongated cavity formed integral with the sole 100, with the material forming the sole defining cavity interior walls. The cavity includes a lower, generally horizontal or transverse chamber 210 and an upper, generally vertical chamber 220 extending depthwise in communication with the horizontal chamber 210. The cavity is asymmetrical, with chambers 210, 220 asymmetrically disposed about a receptacle center vertical axis A-A. The lower chamber 210 is in communication with receptacle opening 230 formed into the ground-facing surface 120 of the sole 100. The opening 230 is defined by a first flexible lip 240 oriented in opposed, spaced relation from a second flexible lip 250. The asymmetrical configuration keys the system to provide unidirectional connection of the cleat assembly 110 to the receptacle 170. This, in turn, aligns the traction elements with respect to the sole 100 in a predetermined orientation. It should be understood, however, that the cavity may be formed to be symmetrical.

Figure 3A:
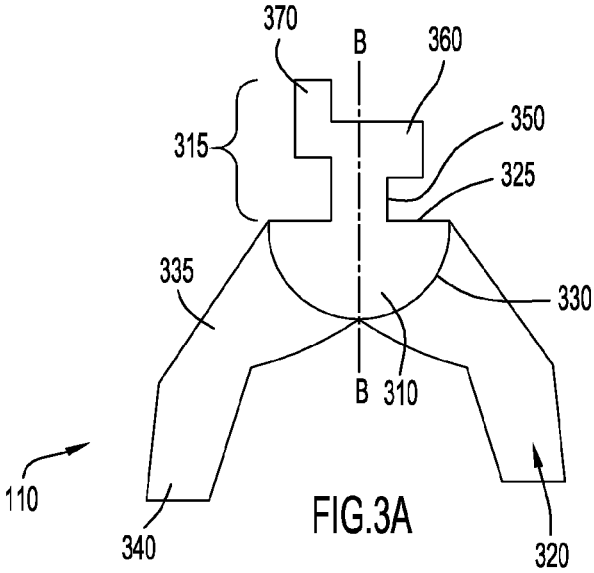
FIG. 3A illustrates a cross sectional view of the cleat assembly shown in FIG. 1.
Figure 3C:
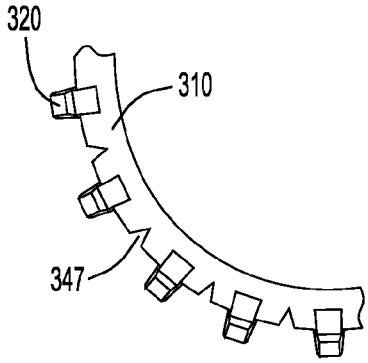
FIG. 3C is a close-up view of the cleat assembly of FIG. 3B, showing the bending of the cleat via flex points.
Figure 3B:
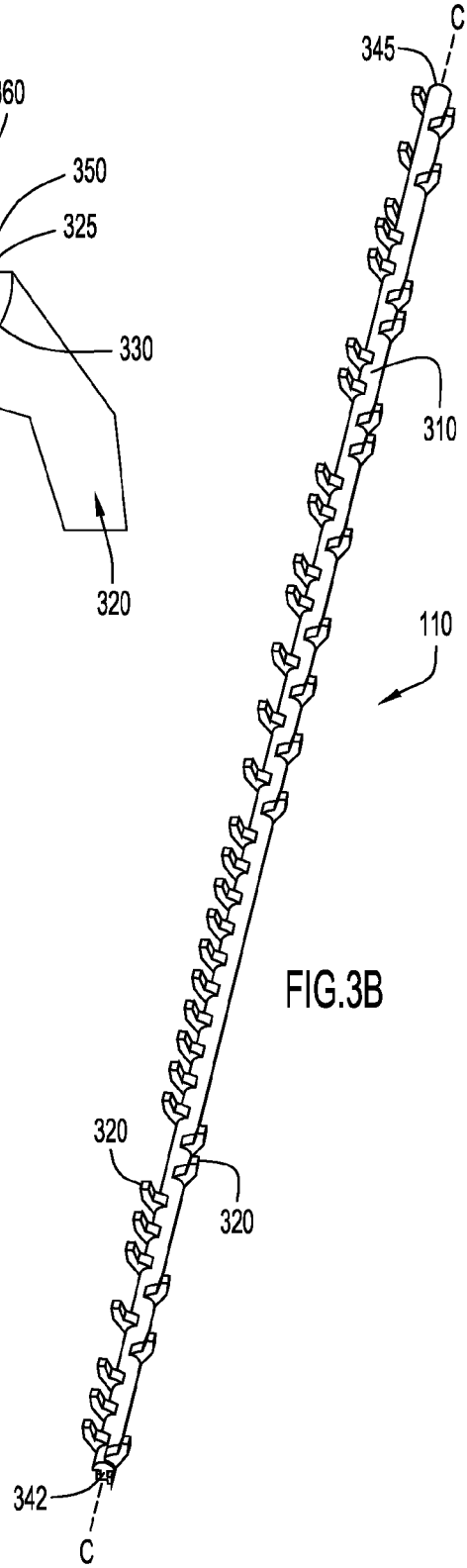
FIG. 3B illustrates a perspective view in isolation of the cleat assembly shown in FIG. 1.

Referring to FIG. 3A, the cleat assembly 110 includes a hub 310, a cleat base or connector 315, and one or more traction elements 320. The hub 310 possesses a substantially semicircular cross section defining a generally flat shoe-facing surface 325 and a generally rounded ground-facing surface 330. A vertical, centrally disposed hub axis B-B serves as a parting line, defining radial sides of the hub 310 and, as such, hub quadrants. This hub center axis B-B aligns with the center axis A-A of the receptacle 170. Consequently, the hub 310 is coaxial with the receptacle 170 when inserted therein. Referring to FIG. 3B, the hub 310 of the cleat assembly 110 is elongated, defining a longitudinal hub axis C-C extending from a first terminal end 342 to a second terminal end 345.

The hub 310 is configured to flex or bend to accommodate the contours of the receptacle arcuate portions. Specifically, the hub 310 flexes laterally along its longitudinal axis. To accommodate this flex, the hub 310 may be formed of a flexible/bendable material. In addition, as illustrated in FIG. 3C, flex points 347 (e.g., V-shaped slits) may be formed into the hub 310 and disposed at predetermined locations to allow looping/bending of the hub. By way of example, the slits are preferably oriented between adjacent traction elements 320, extending radially inward from the ground-facing surface 330 of the hub 310. The flex points 347 enable flexing even when the hub is formed of substantially rigid material.

The traction elements 320 engage the surface when the shoe is brought into contact with the ground. The traction elements 320 may include a plurality of dynamic traction elements, a plurality of static traction elements, or a combination of the two. The dynamic traction elements are resiliently flexible, being configured to resiliently pivot with respect to the hub and deflect toward the sole 100 when the shoe engages a ground surface under load (i.e., under the weight of the wearer of the shoe). Referring back to FIG. 3A, the dynamic traction elements 320 include an arm having a proximal section 335 and a distal or turf-engaging section 340. The proximal section 335 extends angularly outward (i.e., away from the hub axis B-B) and downward (i.e., away from the ground-engaging surface 330 of the hub 310). The turf-engaging section 340 extends generally downward, toward the ground. Each traction element 320 is resiliently deflectably secured to the hub 310 so that, under the weight of the wearer, the traction element 320 is deflected upward, toward the sole 100. Each traction element 320 preferably flexes substantially independently from the others, although adjacent traction elements may cooperate to provide traction.

The dynamic traction elements 320 may optionally include gussets provided along an internal side portion of the arms. The gussets extend along the longitudinal dimension of the traction elements between the terminal end of the traction element 320 and the ground-engaging hub surface 330. The gussets function as resilient "springs" to aid the natural resilience of the traction elements and to pull the elements back into their unflexed positions when they are not under load (for example, when the shoe is lifted by the wearer from the ground). In addition, each gusset acts as a wear surface when the arms are deflected against the shoe sole, so that even the sides of the turf-engaging portions are substantially protected from abrasion.

With the above configuration, the dynamic traction elements 320, when unflexed, extend downward and outward from the ground-engaging surface 330 of the hub 310. When flexed, the traction elements 320 pivot away from the central axis B-B of the hub 310. It will be appreciated, however, that dynamic traction elements are not necessarily required to extend outward. Specifically, the dynamic elements may extend only downward, as long as they flex to provide traction and resist undesired significant ground penetration of the stud under a weight load.

It will be further appreciated that other types of dynamic traction elements may be utilized with the hub 310. By way of example, the traction elements disclosed in U.S. Pat. Nos. 6,305,104 and/or 7,040,043 (both to McMullin) may depend from the hub 310. The disclosures of the aforementioned patents are hereby incorporated by reference in their entireties.

As noted above, the cleat assembly may also include static traction elements. In contrast with dynamic traction elements, static traction elements remain substantially rigid and are resistant to deflection upon engaging the ground surface.

The traction elements 320 (dynamic and/or static) may be oriented in any suitable manner along the hub 310. That is, the traction elements 320 may be symmetrically or asymmetrical oriented along the elongated hub 310. As best seen in FIG. 3B, the hub 310 includes a plurality of dynamic traction elements 320 depending from the ground-facing surface 330 of the hub 310 at spaced longitudinal hub locations, selectively alternating between hub longitudinal edges. Providing such an alternating hub layout results in a straight pull along the hub center axis B-B since the forces occurring across the hub 310 are equalized. Preferably, the traction elements 320 are offset, i.e., no pair of traction elements 320 is latitudinally or transversely aligned across the hub center axis B-B.

The cleat connector 315 engages the receptacle 170 to secure the cleat assembly 110 to the sole 100. The connector 315 includes a stem or beam 350 extending distally from a generally central location on the shoe-facing surface 325 of the hub 310. The stem 350, having generally flat exterior sides, is substantially coaxial with the hub center axis B-B. The distal end of the stem 350 includes a horizontal flange 360 extending transversely from one side of the stem, and a vertical finger 370 extending distally from the opposite side of the stem such that the finger 370 is offset from hub center axis B-B. This structure, then, is complementary to the cavity of the receptacle 170. As noted above, this configuration cooperates with the receptacle 170 to provide a keyed connection between the cleat assembly 110 and the sole 100. In other words, a user may only connect the cleat assembly 110 to the receptacle 170 in one longitudinal direction.

The above-described cleat assembly 110 is preferably formed as a unitary (one-piece) structure. To maintain the functional requirements of each component, the cleat assembly 110 may be formed utilizing a process that creates a one-piece or unitary structure through molding of at least two different polymers together, creating chemical bonds (and, if desired, additional mechanical bonds) between the parts in the same mold or die, and expressly includes, but is not to be limited to, such processes as two-shot molding, co-injection molding, and insert molding. By way of example, two-shot molding involves the injection of two different polymers through two nozzles into one mold which can rotate to allow both materials to fill different areas of the same mold. A harder polymer forming the hub 310 and cleat connector 315 may be injected first (i.e., the first shot) and the softer polymer forming the dynamic traction element 320 may be injected as the second shot. Because the two-shot injection molding process is fast and highly repeatable, the shrinkage of the first shot is very consistent and two different materials can be molded together with virtually no flash. The two polymers are joined by both chemical and mechanical bonds during the molding process. The resulting one-piece cleat assembly 110 is integral and devoid of the problem of the components coming apart as described above in connection with the prior art three-piece cleat.

By way of specific example, the hub 310 and connector 315 may be formed from a first shot of relatively hard and inflexible polymer material, typically polyurethane with a hardness or Durometer in the range of 67D to 75D. Atop and chemically bonded with the hub 310 is molded a second shot comprising the dynamic traction element 320 from a relatively flexible polymer material, typically polyurethane with a Durometer in the range of 82 A to 90 A. Although forms of polyurethane are used for the two shots in the preferred embodiment, it is to be understood that other polymers, in some cases two different polymers, may be utilized.

Figure 4A:
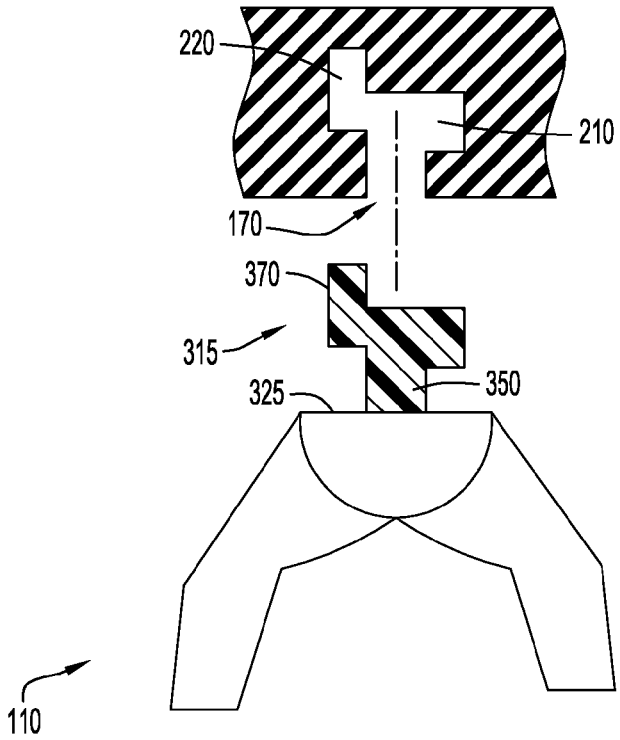
FIGS. 4A and 4B illustrate the connection of the cleat assembly of FIG. 3A to the receptacle shown in FIG. 2.
Figure 4B:
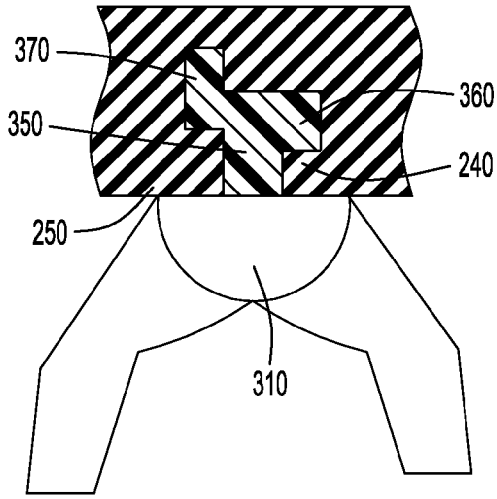

FIGS. 4A and 4B illustrate the connection of the cleat assembly 110 to the sole 100. In operation, the connector 315 of the cleat assembly 110 is positioned to align the finger 370 with the upper chamber 220 of the receptacle 170. The connector 315 is axially urged into the receptacle 170, causing the resilient lips 240, 250 of the opening 230 to flex inward, accommodating the width of the connector 315. Once the shoulder 360 and finger 370 clear the lips 240, 250 and become properly seated in the cavity, the lips 240, 250 flex outward, back to their normal positions, contacting the sides of the stem 350. The dimensions of the hub 310 are such that the hub diameter is larger than the diameter of the receptacle opening 230. As a result, the shoe-facing surface 325 of the hub 310 contacts the ground facing surface 130 of the sole 100, completely covering the opening 230 to prevent the build-up of debris within the receptacle 170.

Figure 5A:
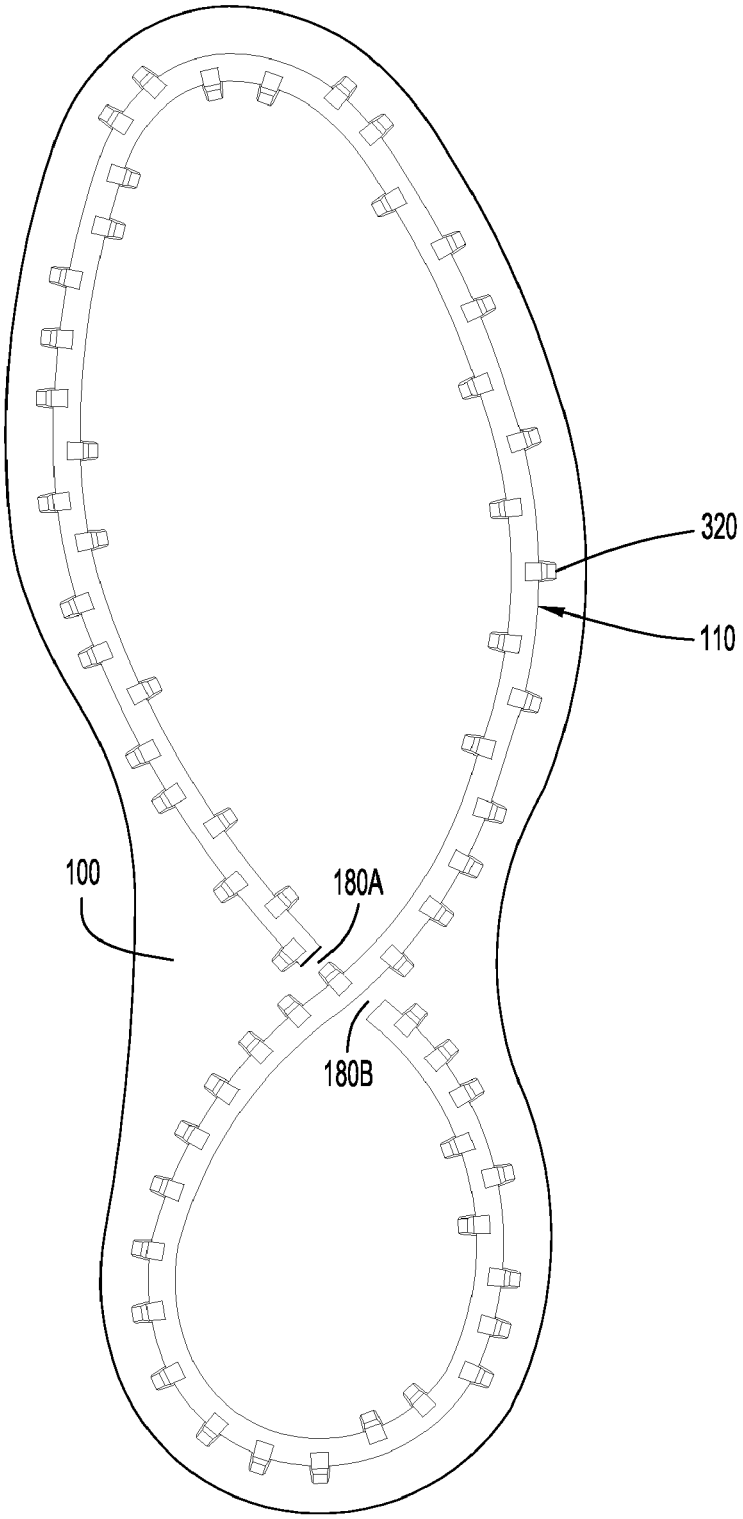
FIGS. 5A and 5B illustrates bottom and side views, respectively, of a shoe including the cleat system in accordance with an embodiment of the invention.
Figure 5B:
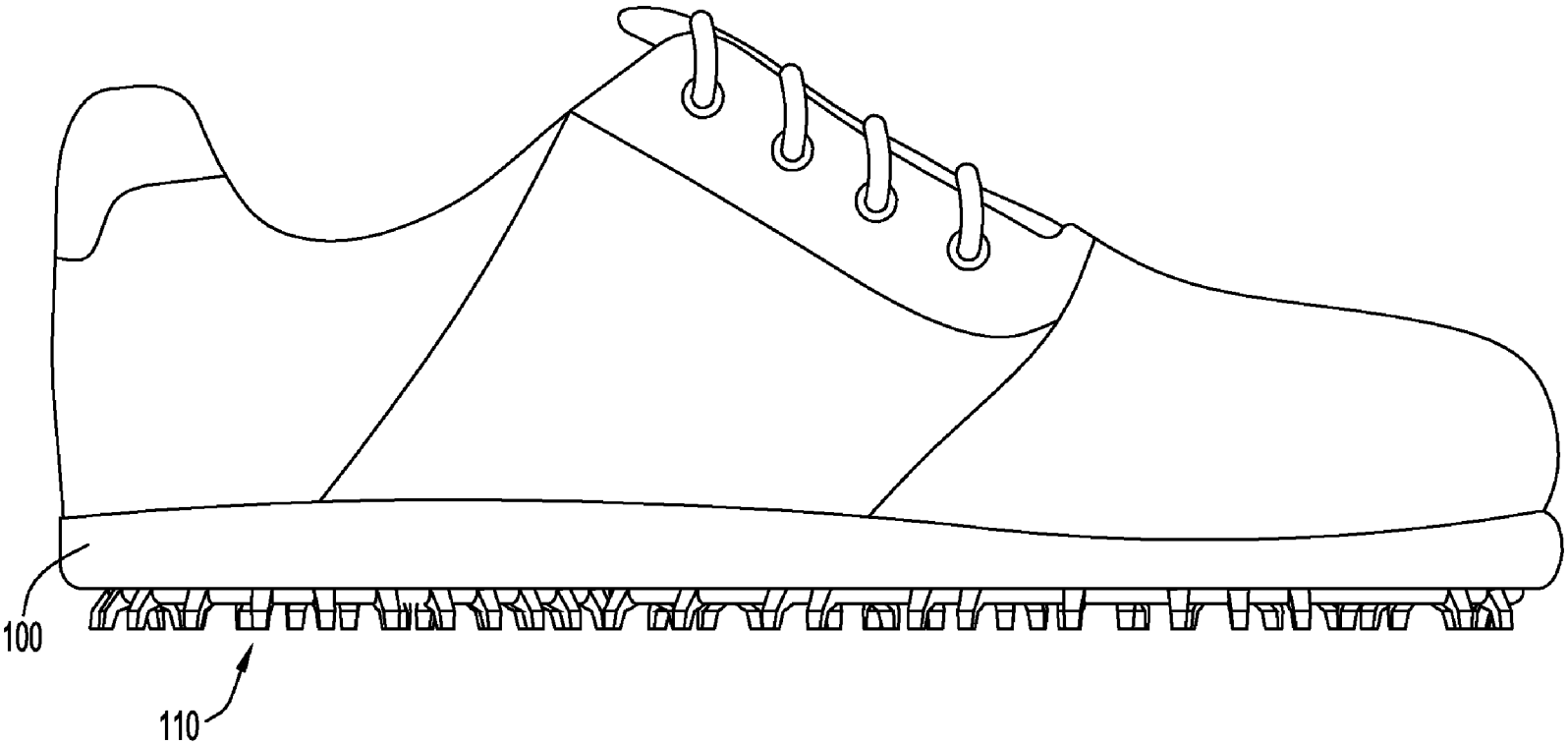

Once connected to the receptacle 170, a friction fit exists between the connector 315 and the interior walls of the receptacle, securing the cleat assembly 110 to the sole 100 during normal use. As illustrated in FIGS. 5A and 5B, the cleats extend downward from the sole as described above. The snug connection between the cleat assembly 110 and the receptacle 170 is sufficient to maintain connection during use (i.e., when the sole 100 is subject to rotational and lateral forces), but will permit separation of the cleat assembly and the receptacle upon application of an axial force sufficient to draw the connector 315 out through the opening 230 of the receptacle. Thus, when replacement of the traction elements 320 is desired, the cleat assembly 110 is axially drawn out from the receptacle 170 by the user applying force sufficient to overcome the frictional connection. By way of example, a specially designed tool may be utilized to apply a force sufficient to disconnect the cleat assembly 110 from the receptacle 170.

With the above-described configuration, a cleat system is provided that enables simplified removal and connection of cleats from the sole of an athletic shoe. The cleat assembly may be removed or added to an athletic shoe in its entirety. This is in direct contrast to conventional cleat systems, which require the individual removal of cleats connected to a plurality of receptacles, often via the use of special tools.

In addition, the elongated hub/receptacle configuration positions the traction elements to closer to the outsole peripheral edge 160 when compared to traditional cleat mounting connectors having circular bases. Thus, the traction elements 320 may be positioned farther away from the center of rotation of the shoe than that provided conventional mounting connectors. This, in turn, provides improved stability during use of the shoe. That is, above-described embodiment effectively utilizes the concept of a lever in which the computation of energy is (Force)×(Distance). Since a cleat is an attempt to offset energy, the amount of resistance provided by the cleat is also computed as (Force)×(Distance). Rotational forces created during activities such as a golf swing are a result of foot twisting around the center point of the shoe. Consequently, the further the cleats are moved away from the center of the rotation, the greater the amount of resistance to the twisting energy. In addition, moving from rotational traction to a different force present during the swing (that of the weight shift during the swing and the resulting lateral forces) creates instability for the golfer. Consequently, by placing the traction elements 320 further away from the rotational center of the shoe provides a more stable platform for the golfer. This more stable platform results from the cleat being the foundation of the golfer's connection to the ground. The wider the foundation, the greater is the stability.

Thus, the present system recognizes the benefits of placing the traction elements 320 farther from the center of rotation of the shoe when compared to conventional rounded receptacles. The elongated receptacle/hub configuration enables the placement of the receptacle axis A-A closer to the outsole peripheral edge 160 without encroaching on the clearance required by the shoe manufacturers. A decrease in distance of about 10-15% (e.g., a decrease of about three millimeters) is significant when compared to the conventional distance between the receptacle axis and the outsole edge, which is no less than 13 mm from the outsole peripheral edge.

While the invention has been described in detail and with reference to specific embodiments thereof, it will be apparent to one skilled in the art that various changes and modifications can be made therein without departing from the spirit and scope thereof. For example, in addition to being a continuous notch, the receptacle pattern may also be defined by a series of individual segments placed at predetermined positions along the sole 100. The dimensions (e.g., length) of the hub 310 are not particularly limited. In a preferred embodiment, the hub defines a strip having a length greater than the length of the sole 100.

The cleat assembly 110, moreover, can include any suitable number of dynamic or static traction elements (for example, one or more dynamic traction elements) arranged in any suitable symmetric or asymmetric patterns along the hub 310 depending upon a particular application and traction function required for the cleat. The traction elements 320 may include multi-faceted surfaces that can have a slight taper inward toward the terminal ends of the traction elements. It is noted, however, that the cleats of the present invention can include one or more traction elements having any one or more suitable geometric configurations, including two or more traction elements on a single cleat having different geometric configurations and/or different lengths or axial dimensions, so long as the dynamic traction elements maintain their resilient flexibility during use of the cleat as described above. In addition, the dynamic traction elements may be provided with small barbs extending downward from their distal ends to enhance traction by digging slightly into the turf or ground surface as they flex under load.

In addition, the materials forming the sole 100 and the cleat assembly 110 may include, but are not limited to, resilient materials, rigid materials, and combinations thereof. The dynamic traction elements 320 may be formed form resilient material such as polyurethane or other flexible elastomer. The hub 310 may be made from the same material as the dynamic traction elements or, alternatively, from a different material. In addition, the hub 310 and traction elements 320 may be formed from entirely from a single material such as polyurethane or other flexible, durable elastomer.

Thus, it is intended that the present invention cover the modifications and variations of this invention that come within the scope of the appended claims and their equivalents. It is to be understood that terms such as "left", "right" "top", "bottom", "front", "rear", "side", "height", "length", "width", "upper", "lower", "interior", "exterior", "inner", "outer" and the like as may be used herein, merely describe points of reference and do not limit the present invention to any particular orientation or configuration.

We claim:

1. A traction cleat system for an athletic shoe, the system comprising:

a sole having a ground-facing surface and a shoe-facing surface that cooperate to define a sole peripheral edge, wherein the sole possesses a longitudinal dimension and latitudinal dimension; and an elongated receptacle disposed within the sole; and a cleat assembly configured to releasably couple to the receptacle, the cleat assembly comprising:

a cleat connector, an elongated hub having a substantially semicircular cross section defining generally rounded, ground-facing surface and a generally flat, shoe-facing surface, and a plurality of traction elements depending from and spaced longitudinally along the hub, wherein shoe-facing surface of the hub is configured to cover the receptacle when the cleat assembly is coupled to the receptacle to prevent debris from entering the receptacle.

2. The traction cleat system of claim 1, wherein:

at least a portion of the receptacle extends along the sole longitudinal dimension; and the elongated receptacle comprises an arcuate portion that curves laterally as it extends along the sole longitudinal dimension.

3. The traction cleat system of claim 2, wherein the elongated hub is configured to bend such that it contours to the curves of the receptacle.

4. The traction cleat system of claim 1, wherein the elongated receptacle comprises an asymmetrical cavity configured to receive the cleat assembly in a predetermined orientation and to align the traction elements in a predetermined orientation with respect to the sole.

5. The traction cleat system of claim 1, wherein:

the elongated hub comprises a central hub axis that divides the hub into a first hub quadrant and a second hub quadrant; and the plurality of traction elements comprises:

a first traction element depending from the first hub quadrant, and a second traction element depending from the second hub quadrant.

6. The traction cleat system of claim 1, wherein:

the elongated hub defines a longitudinal hub axis; and the elongated hub further comprises flex points that enable lateral bending of the hub along the longitudinal hub axis.

7. The traction cleat system of claim 1, wherein:

the sole includes a forward sole portion, an intermediate sole portion, and a rear sole portion; and the elongated receptacle extends from the forward sole portion to the rear sole portion.

8. The traction cleat system of claim 1, wherein the receptacle comprises a cavity formed into the sole.

9. An athletic shoe comprising:

a sole including a shoe-facing surface and a ground-facing surface that cooperate to define sole peripheral edge;

an elongated receptacle for a traction cleat, wherein the receptacle comprises an arcuate portion that curves as the receptacle extends along the sole; and a cleat assembly coupled to the receptacle, the cleat assembly comprising:

an elongated hub comprising substantially semicircular cross section defining generally rounded, ground-facing surface and a generally flat, shoe-facing surface, a traction element depending from the hub ground-facing surface, and a cleat connector extending distally from the hub-shoe-facing surface, wherein the cleat connector is adapted to mate with the receptacle.

10. The athletic shoe of claim 9, wherein the cleat connector mates with the receptacle in a predetermined orientation to align the traction element in a predetermined position with respect to the sole.

11. The athletic shoe of claim 9, wherein the cleat assembly comprises a unitary structure formed via a molding process.

12. The athletic shoe of claim 9, wherein:

the hub comprises one or more flex points, each flex point configured to enable bending of the hub at the flex point; and at least one flex point comprises a radially extending notch formed into the hub.

13. The athletic shoe of claim 9, wherein the hub comprises material having a first hardness value, the traction element comprises material having a second hardness value, the first hardness value being different from the second hardness value.

14. The athletic shoe of claim 9, wherein:

the receptacle comprises an elongated, asymmetrical cavity formed within the sole; and the cavity is configured to receive the cleat assembly in a predetermined orientation such that the traction elements align with the sole in a predetermined position.

15. The athletic shoe of claim 9, wherein the elongated hub is configured to flex along its longitudinal axis to accommodate the arcuate portion of the receptacle.

16. The athletic shoe of claim 9, wherein a plurality of traction elements depend from the hub in longitudinally spaced relation.

17. A method of providing traction to the sole of an athletic shoe, the method comprising:

(a) forming a sole having:

a forward portion, an intermediate portion, and a rear portion, a ground-facing surface and a shoe-facing surface that cooperate to define a sole peripheral edge, and a sole longitudinal dimension and sole latitudinal dimension;

(b) forming an elongated receptacle within the sole, wherein the receptacle couples to a traction cleat, wherein at least a portion of the receptacle extends along the sole longitudinal dimension; and (c) coupling a cleat assembly to the receptacle, the cleat assembly including:

a cleat connector, and an elongated hub having a substantially semicircular cross section defining generally rounded, ground-facing surface and a generally flat, shoe-facing surface, and a plurality of traction elements depending from and spaced longitudinally along the hub, wherein shoe-facing surface of the hub is configured to cover the receptacle to prevent debris from entering the receptacle when the cleat assembly is coupled to the receptacle.

18. The method of claim 17, wherein the plurality of traction elements depend from the ground-facing surface of the hub.

19. The method of claim 17, wherein:

the hub comprises an elongated hub defining a longitudinal hub axis;

the hub is configured to flex laterally along its longitudinal hub axis; and the method further comprises (d) flexing the hub to accommodate the arcuate portion of the receptacle.

20. The traction cleat system of claim 1, wherein at least a portion of the receptacle extends along the sole longitudinal dimension.

21. The traction cleat system of claim 1, wherein the cleat connector mates with the receptacle in a predetermined orientation to align the traction elements in a predetermined position with respect to the sole.

22. The traction cleat system of claim 1, wherein the cleat assembly comprises a unitary structure formed via a molding process.

23. The traction cleat system of claim 1, wherein:

the hub comprises a flex point, each flex point configured to enable bending of the hub at the flex point; and the flex point comprises a radially extending notch formed into the hub.

24. The traction cleat system of claim 1, wherein the hub comprises material having a first hardness value, and the at least one traction element comprises material having a second hardness value, the first hardness value being different from the second hardness value.

* * * * *